US007883175B2

(12) United States Patent
Otsuka et al.

(10) Patent No.: US 7,883,175 B2
(45) Date of Patent: Feb. 8, 2011

(54) LIQUID EJECTING APPARATUS

(75) Inventors: Nobutoshi Otsuka, Azumino (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 406 days.

(21) Appl. No.: 12/105,721

(22) Filed: Apr. 18, 2008

(65) Prior Publication Data

US 2008/0259118 A1 Oct. 23, 2008

(30) Foreign Application Priority Data

Apr. 18, 2007 (JP) ..... 2007-109207

(51) Int. Cl.
*B41J 2/165* (2006.01)

(52) U.S. Cl. ..... 347/32; 347/19; 347/20; 347/22; 347/29; 347/30; 347/31; 347/33

(58) Field of Classification Search ..... 347/19, 347/30, 32
See application file for complete search history.

(56) References Cited

U.S. PATENT DOCUMENTS 6,109,727 A * 8/2000 Akahira et al. ..... 347/42
6,224,205 B1 * 5/2001 Akahira et al. ..... 347/107
2007/0222817 A1 * 9/2007 Kurita et al. ..... 347/40
2007/0256709 A1 * 11/2007 Shang et al. ..... 134/18
2008/0024532 A1 * 1/2008 Kim ..... 347/9

FOREIGN PATENT DOCUMENTS

JP 2003-154672 5/2003

* cited by examiner

*Primary Examiner*—Ryan Lepisto
(74) *Attorney, Agent, or Firm*—Workman Nydegger

(57) ABSTRACT

A liquid ejecting apparatus according to the invention includes a liquid ejecting head capable of ejecting liquid from nozzle openings provided in a nozzle-forming surface, a nozzle-forming-surface visual-inspection unit for enabling a visual inspection of the nozzle-forming surface, and a liquid receptacle for receiving liquid discharged as waste liquid from the nozzle openings in the liquid ejecting head. The liquid receptacle is movable between a receiving position, where the liquid receptacle is positioned adjacent to the nozzle-forming surface, and a non-receiving position, where the liquid receptacle is positioned away from the receiving position. The liquid receptacle covers the nozzle-forming-surface visual-inspection unit when the liquid receptacle is positioned at the receiving position. The nozzle-forming-surface visual-inspection unit allows the nozzle-forming surface to be visually inspected when the liquid receptacle is positioned at the non-receiving position.

9 Claims, 3 Drawing Sheets

LIQUID EJECTING APPARATUS

The entire disclosure of Japanese Patent Application No. 2007-109207, filed Apr. 18, 2007 is expressly incorporated herein by reference.

BACKGROUND

1. Technical Field

The present invention relates to a liquid ejecting apparatus. More particularly, the present invention relates to a liquid ejecting apparatus including a liquid ejecting head which is capable of ejecting liquid from nozzle openings.

2. Related Art

Ink jet printers (hereinafter, referred to as "printers") are known examples of liquid ejecting apparatuses which are capable of ejecting liquid from a plurality of nozzles provided in a liquid ejecting head. These printers typically have a maintenance unit for performing a variety of maintenance operations to prevent and resolve any clogging in the nozzles due to thickened ink.

One example of a maintenance currently used in the art is disclosed in Japanese Patent No. JP-A-2003-154672, which describes a maintenance unit having a vacuuming mechanism for vacuuming ink in a recording head, which serves as a liquid ejecting head, and a wiper mechanism for wiping the surface provided with nozzles (hereinafter, a "nozzle-forming surface"). Other maintenance units currently known in the art are equipped with a flushing box which receives ink discharged from nozzle openings in accordance with a driving signal unrelated to printing.

When the variety of maintenance operations performed by the maintenance units do not resolve a clogging in the recording head, the recording head is removed from a printer body to so that a visual inspection of the nozzle-forming surface may be performed. If the defect in the recording head is determined is identified during the visual inspection and subsequently fixed, the recording head is reattached to the printer body. For example, when ink has been deposited near the nozzles, the deposit is removed using a cotton bud soaked with a cleaning liquid. If no resolvable defect is found during the visual inspection of the recording head, the defect is deemed to be located inside the recording head, and the recording head is replaced with a new recording head.

One problem with this process, however, is that removing the recording head to visually inspect the recording head for defects wastes time because reattaching and repositioning the recording head to properly attach the recording head to the printer is time-consuming work.

This situation occurs not only with the ink jet printers as described above, but also with other liquid ejecting apparatuses having a liquid ejecting head for ejecting liquid from nozzle openings.

BRIEF SUMMARY OF THE INVENTION

An advantage of some aspects of the invention is that it provides a liquid ejecting apparatus that enables an inspection for determining the cause of clogging of nozzle openings without needing to remove a liquid ejecting head.

A liquid ejecting apparatus according to the invention includes a liquid ejecting head for ejecting liquid from nozzle openings provided in a nozzle-forming surface, a nozzle-forming-surface visual-inspection unit for enabling a visual inspection of the nozzle-forming surface, and a liquid receptacle for receiving liquid discharged as waste liquid from the nozzle openings in the liquid ejecting head. The liquid receptacle is movable between a receiving position, where the liquid receptacle is positioned adjacent to and faces the nozzle-forming surface, and a non-receiving position, where the liquid receptacle is positioned away from the receiving position. The liquid receptacle covers the nozzle-forming-surface visual-inspection unit when the liquid receptacle is positioned at the receiving position. The nozzle-forming-surface visual-inspection unit allows the nozzle-forming surface to be visually inspected when the liquid receptacle is positioned at the non-receiving position.

This structure uses the nozzle-forming-surface visual-inspection unit to allow visual inspection of the nozzle-forming surface, whereby the cause of clogging can be easily inspected without needing to remove the liquid ejecting head from the liquid ejecting apparatus. Accordingly, the time required for removing and reattaching a liquid ejecting head can be saved. When the liquid receptacle is positioned at the receiving position, the liquid receptacle covers the nozzle-forming-surface visual-inspection unit. Because the liquid receptacle and the nozzle-forming-surface visual-inspection unit overlap each other in the direction perpendicular to the moving direction of the liquid receptacle, the provision of the nozzle-forming-surface visual-inspection unit does not increase the size of the liquid ejecting apparatus.

The positioning of a liquid ejecting head requires precision, and is quite time-consuming work. In this configuration, because the liquid ejecting head is provided in a plurality, the time required for removing and reattaching the liquid ejecting head can be saved effectively.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink jet printer (hereinafter referred to as a "printer") according to one embodiment of the invention will now be described with reference to FIGS. 1 to 5.

Figure 1:
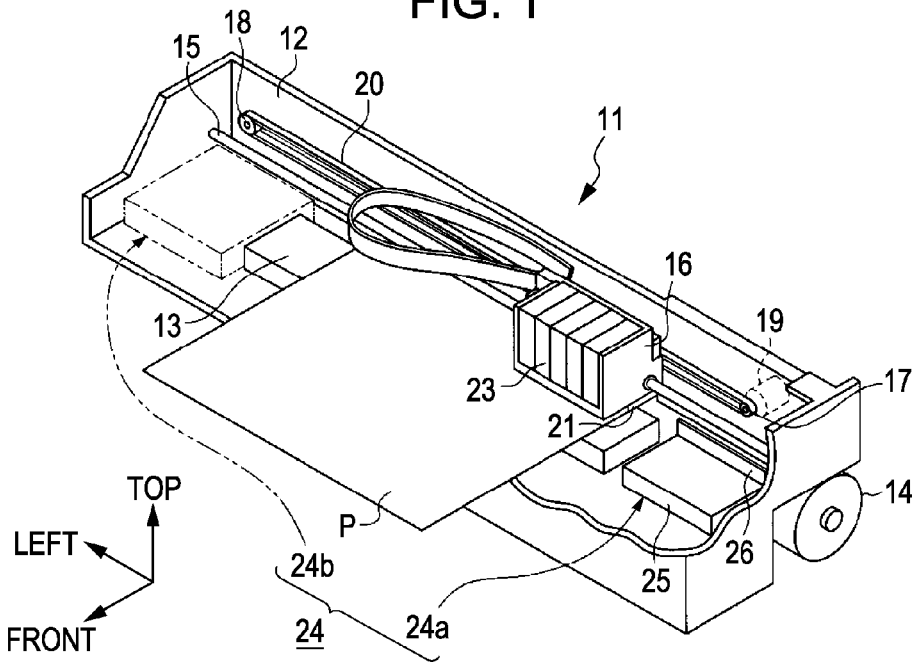
FIG. 1 is a perspective view of an ink jet printer according to one embodiment of the present invention.

FIG. 1 illustrates a printer 11, which serves as a liquid ejecting apparatus, according to one embodiment of the present invention. The printer 11 has a substantially box-shaped body case 12. A platen 13 extends in the lengthwise direction along the bottom surface of the body case 12, in a main scanning direction, shown as the left to right direction in FIG. 1. The platen 13 serves as a stage for supporting recording paper P, and feeds the recording paper P in the subscanning direction (shown as the front to rear direction in FIG. 1) which is perpendicular to the main scanning direction using a driving force from a paper feed motor 14.

In the body case 12, a pole-like guide shaft 15 is disposed above the platen 13. The guide shaft 15 supports a carriage 16 in a movable manner. A driving pulley 17 and a driven pulley 18 are supported in a rotatable manner on an inner surface of the body case 12 at positions which correspond to each end of the guide shaft 15. A carriage motor 19, which serves as a source of a driving force to reciprocate the carriage 16, is connected to the driving pulley 17. A timing belt 20 which supports the carriage 16 runs over the pair of pulleys 17 and 18. Thus, the carriage 16 is guided by the guide shaft 15 and driven by the carriage motor 19, and is moved in the main scanning direction via the timing belt 20.

Figure 2:
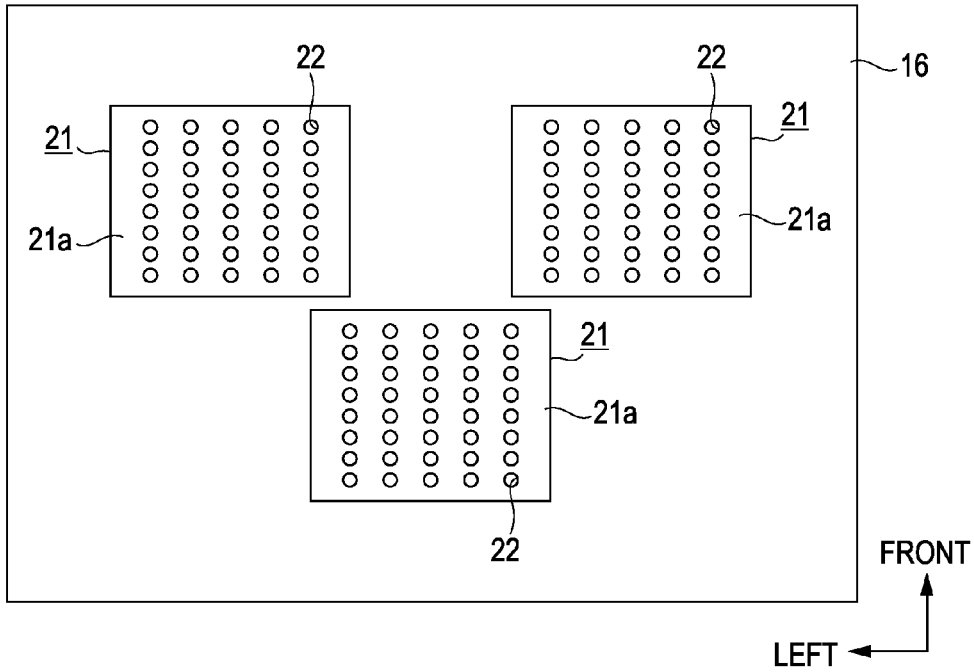
FIG. 2 is a bottom view of a recording head according to the embodiment of the invention shown in FIG. 1.

Referring to FIG. 2, a plurality (three, in the present embodiment) of recording heads 21, which serve as liquid ejecting heads, are provided on the bottom surface of the carriage 16. The bottom surface of each recording head 21 constitutes a nozzle-forming surface 21*a*, in which a plurality of nozzle openings 22 are provided. As shown in FIG. 1, a plurality (five, in the present embodiment) of ink cartridges 23 are removably fitted in the carriage 16 for supplying the recording heads 21 with a liquid, such as ink. A printing process is performed by ejecting ink stored in the ink cartridges 23 through the nozzle openings 22 onto the recording paper P.

Maintenance units 24*a* and 24*b*, referred collectively as maintenance units 42, are provided on both ends of the body case, and are used for preventing and resolving clogging of the nozzle openings 22 caused by thickened ink. In one embodiment of the present invention, the ends (right and left ends in FIG. 1) of the body case 12 may be referred to as non-printing regions where the recording paper P does not extend.

In one embodiment of the invention, the maintenance unit 24*a* provided on the right side of the body case 12 shown in FIG. 1, includes a cap member 25, a vacuum pump (not shown), and a wiper member 26.

The maintenance unit 24*b* provided on the opposite end (left end in FIG. 1) of the body case 12 will be described with reference to FIGS. 3 to 5.

Figure 3:
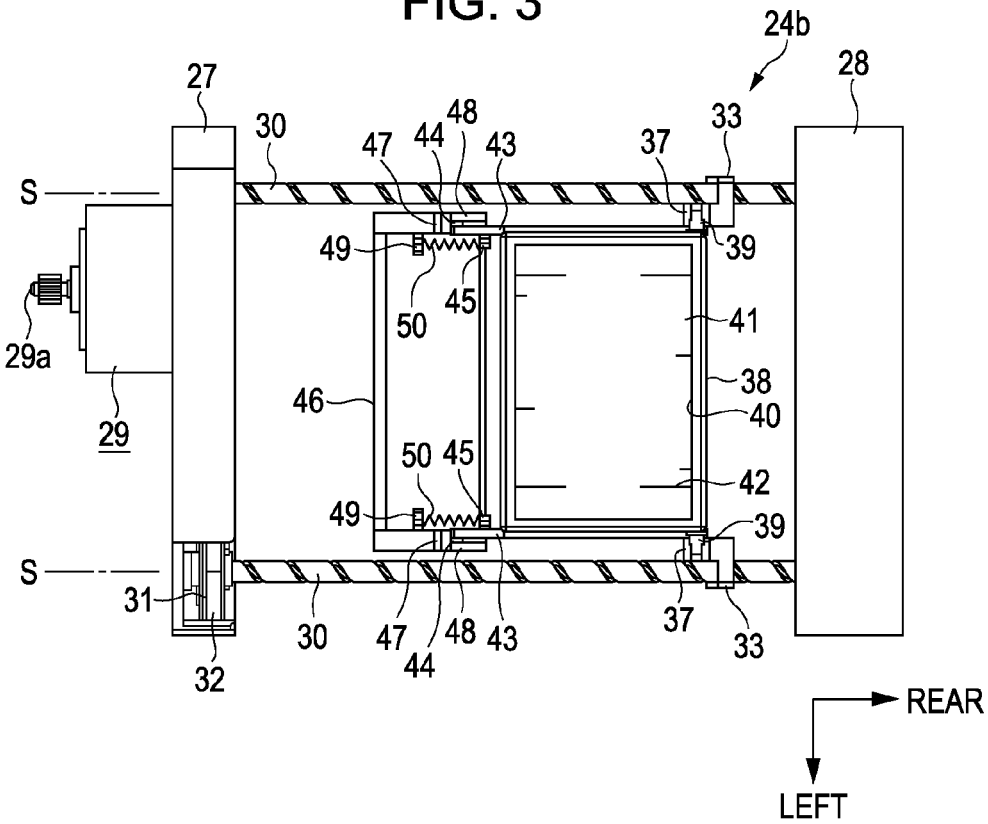
FIG. 3 is a plan view of a portion of a maintenance unit.
Figure 4:
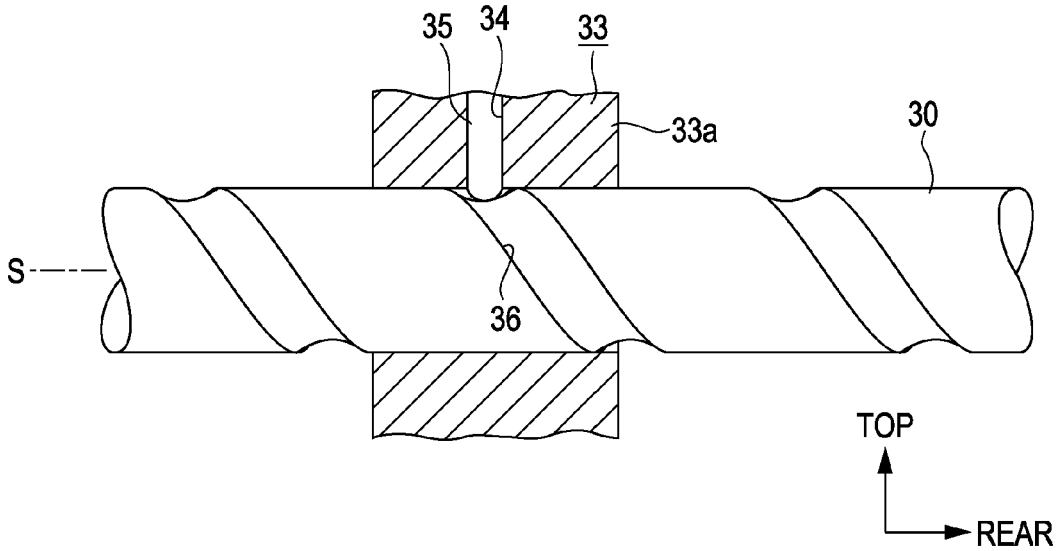
FIG. 4 is a sectional view showing an engagement between a lead screw and a tubular portion of a moving member.

Referring to FIG. 3, the maintenance unit 24*b* includes a front frame 27 and a rear frame 28 supported by the body case 12 through brackets (not shown). A driving motor 29 capable of bidirectional rotation is attached to the front frame 27. A timing belt pulley (not shown) for transmitting power is connected to the rear end of the output shaft 29*a* of the driving motor 29.

Two parallel lead screws 30, which extend in a substantially horizontal direction between the front frame 27 and the rear frame 28, are provided so as to be separated from each other a predetermined distance in the left-right direction. A timing belt pulley 31 is fitted to the front end of each lead screw 30. An endless pinion belt 32 runs over the timing belt pulleys 31 which are connected to the output shaft 29*a* of the driving motor 29. The lead screws 30 are rotatably supported by the rear frame 28 at one end. As the driving motor 29 rotates to generate a driving force, the lead screws 30 synchronously rotate in the same direction about their shaft axes S.

The lead screws 30 are each fitted with a moving member 33. As shown in FIG. 4, the moving member 33 has a tubular portion 33*a* that is engaged with the lead screw 30. The tubular portion 33*a* has a hole 34, which radially penetrates the tubular portion 33*a*, into which a pin 35 is inserted. Inside the tubular portion 33*a*, the tip of the pin 35 is engaged with a screw thread 36 formed on the outer peripheral surface of each lead screw 30.

When the lead screws 30 are rotated, the screw threads 36 guide the pins 35 engaged therewith, causing the moving members 33 to move frontward and rearward along the shaft axes S of the lead screws 30 in a synchronized manner.

In the present embodiment, when the driving motor 29 rotate in a clockwise direction, the lead screws 30 rotate in the same clockwise direction, causing the moving members 33 to move rearward from the front frame 27 towards the rear frame 28. In contrast, when the driving motor 29 is reversed, and rotated in a counter-clockwise direction, the lead screws 30 rotate in the reverse direction, causing the moving members 33 to move forward from the rear frame 28 toward the front frame 27.

As shown in FIG. 3, a supporting piece 37 is provided at the front end of each moving member 33 so as to project frontward from the inside of the tubular portion 33*a*. The supporting pieces 37 of the moving members 33 support a pair of shafts 39, which are provided so as to horizontally project from both the left and right surfaces of the rear side of the flushing box 38, in a rotatable manner.

Figure 5A:
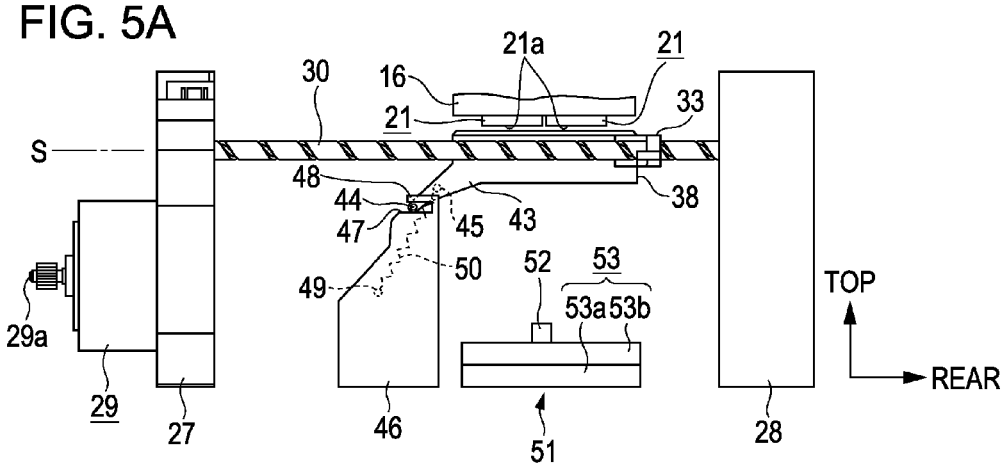
FIGS. 5A-5C are side views of the maintenance unit shown in FIG. 3.

The flushing box 38 has an open box-shaped receiving portion 40 having a bottom surface where ink may be collected. When the carriage 16 is moved to the position above the maintenance unit 24*b* while the moving members 33 are positioned as shown in FIG. 5A, the receiving portion 40 is positioned below the recording heads 21, with the opening thereof closely facing the nozzle-forming surface 21*a*. That is, at this time, the flushing box 38 is positioned at the receiving position where it can receive ink discharged from the nozzle openings 22 in the recording heads 21. The receiving portion 40 contains an ink absorber 41 fixed to the receiving portion 40 using a wire 42. The ink absorber 41 is capable of absorbing and retaining discharged ink.

As shown in FIGS. 3 and 5, plate-like leg portions 43 are provided so as to extend diagonally (in a diagonally frontward direction, in FIG. 5A) from both sides of the front end of the flushing box 38. Each leg portion 43 has a cylindrical engaging projection 44 which projects horizontally from the outer surface of the front tip for the leg portion 43 and a pin 45 which projects horizontally from the central portion of the inner surface of the leg portion 43.

Figure 5B:
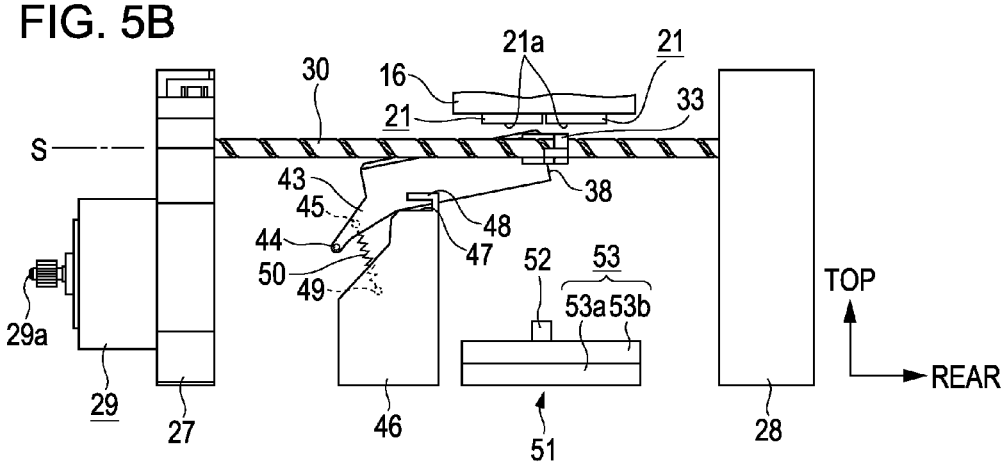
Figure 5C:
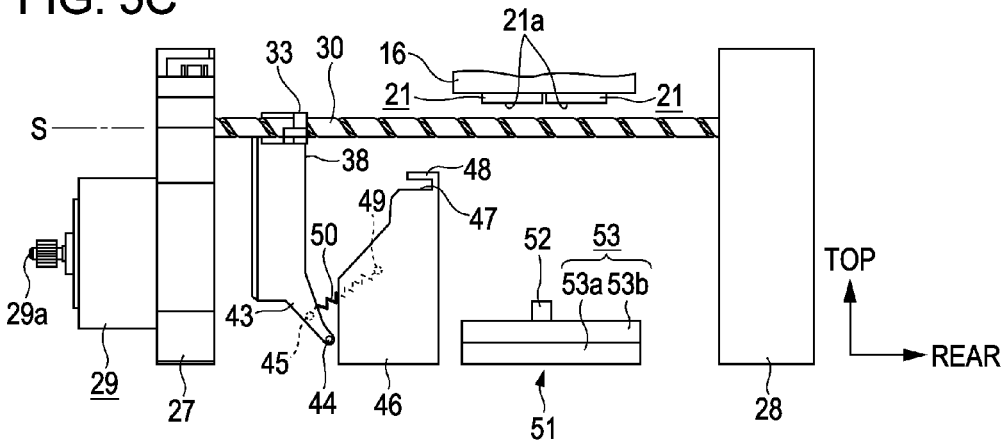

A stepped member 46 having a rectangular shape is disposed between the front frame 27 and the rear frame 28, at a position near the front frame 27. Both the left and right side walls of the stepped member 46 have a substantially trapezoidal shape as shown in FIGS. 5A to 5C, and the top surfaces thereof constitute stepped portions 47 having a predetermined width in the left to right direction as shown in FIG. 3. The front upper corners of the stepped portions 47 are chamfered to form inclined surfaces which extend diagonally downward. The left and right stepped portions 47 are each provided with an engaging projection 48, which is substantially L-shaped which projects frontward at the rear ends thereof, and a pin 49 horizontally projecting from the inner surfaces thereof.

Each pin 45 of the flushing box 38 is connected to the corresponding pin 49 of the stepped member 46 through a coil spring 50. The coil springs 50 exert a force on the flushing box 38 in the counterclockwise direction in FIGS. 5A to 5C, using the shafts 39 as the fulcrum of rotation. When the moving members 33 are positioned as shown in FIG. 5C, the flushing box 38 is oriented perpendicularly with the opening of the receiving portion 40 facing frontward, and the flushing box 38 is held at the non-receiving position away from the receiving position.

The width of the flushing box 38 in the left-right direction is designed such that when both the left and right leg portions 43 are positioned on the stepped portions 47, the engaging projections 44 of the leg portions 43 engage the engaging projections 48 of the stepped portions 47, as shown in FIG. 5A, such that the receiving portion 40 is positioned between the engaging projections 48, as shown in FIG. 3. This allows the flushing box 38 to pass between the two engaging projections 48 of the stepped member 46 and over the stepped portions 47, and move in the front-rear direction. Since the front upper portions of the stepped portions 47 constitute inclined surfaces, the flushing box 38 smoothly slides along the surfaces when it passes over the stepped portions 47, as shown in FIG. 5B.

More specifically, when the moving members 33 are moved rearward while the flushing box 38 is held at the non-receiving position as shown in FIG. 5C under the urging force of the coil spring 50, both the left and right ends of the bottom surface of the flushing box 38 contact the stepped portions 47, so as to be oriented obliquely as shown in FIG. 5B. Then, the flushing box 38 moves along with the moving members 33, gradually changing its orientation from oblique to horizontal. Finally, the flushing box 38 is oriented horizontally while the engaging projections 44 are engaged with the engaging projections 48, and the leg portions 43 are supported by the stepped portions 47, as shown in FIG. 5A.

Thus, the flushing box 38 is capable of moving from the receiving position where the receiving portion 40 closely faces the nozzle-forming surface 21*a* to the non-receiving position distant away from the receiving position.

As shown in FIGS. 5A to 5C, a nozzle-forming-surface visual-inspection unit 51 is disposed at a position between the front frame and the rear frame 28, to the rear side of the stepped member 46, that is below the receiving portion 40 when the flushing box 38 is positioned at the receiving position as shown in FIG. 5A.

The nozzle-forming-surface visual-inspection unit 51 has a microscope 52, and an X-Y table 53, which serves as a driving mechanism, for supporting the microscope 52. The X-Y table 53 includes an X table 53*a* for moving the microscope 52 in the front-rear direction, and a Y table 53*b* for moving the microscope 52 in the left-right direction. The X-Y table 53 moves the microscope 52 in both the front-rear direction and left-right direction to change the field of view of the microscope 52. The X-Y table 53 is driven by a source of a driving force (not shown), which is provided in addition to the driving motor 29.

The microscope 52 takes an image of the region above it, and outputs the image in the form of an image signal. The image signal output from the microscope 52 is reproduced on the monitor (not shown) provided on the outer surface of the body case 12.

When the carriage 16 is moved to the position above the maintenance unit 24*b* while the flushing box 38 is positioned at the non-receiving position, as shown in FIG. 5C, the microscope 52 can take an image of the nozzle-forming surface 21*a*. Thus, the nozzle-forming surface 21*a* can be visually inspected through the monitor by reproducing the image taken by the microscope 52 on the monitor. In contrast, while the flushing box 38 is positioned at the receiving position, as shown in FIG. 5A, the flushing box 38 blocks the view of the nozzle-forming-surface visual-inspection unit 51.

Operation of the maintenance units 24 having the above-described structures will now be described.

When, for example, a discharge failure occurs when nozzles become clogged by thickened ink during printing, a declogging process may be performed as a maintenance operation, wherein ink from the recording heads 21 is sucked and removed using the cap member 25 and a vacuum pump.

During this process, the carriage 16 is moved to the position above the maintenance unit 24*a*. Then, the cap member 25 is moved upward and brought into contact with the recording heads 21 so as to enclose the nozzle openings 22. When the vacuum pump drives, the thickened ink in the recording heads 21 is vacuumed and removed from the nozzle openings 22.

When ink is discharged from the nozzle openings 22 in the recording heads 21 onto the recording paper P during printing, the ink droplets may bounce back from the recording paper P and become deposited on the nozzle-forming surface 21*a*. Such deposited ink may affect the direction of ink discharge from the nozzle openings 22, and may cause a printing failure. Therefore, wiping of the nozzle-forming surface 21*a* with a wiper member 26 may be performed as a maintenance operation.

During this process, the carriage 16 is moved to the position above the maintenance unit 24*a*. Then, the wiper member 26 is moved rearward and brought into contact with the nozzle-forming surface 21*a* in a slidable manner, in order to wipe off the deposited ink.

When, for example, ink is continuously discharged from specific nozzle openings 22, ink in idle nozzles may thicken because of water evaporation. Because thickened ink may cause a printing failure by clogging the nozzle openings 22, a flushing process may be performed, wherein ink is discharged as waste liquid from the nozzle openings 22 in accordance with a driving signal unrelated to printing.

In this case, the carriage 16 is moved to the position above the maintenance unit 24*b*. In the maintenance unit 24*b*, the flushing box 38 is normally at the receiving position, as shown in FIG. 5A, during printing. Therefore, when the nozzle openings 22 are caused to discharge ink while the carriage 16 is at the region above the maintenance unit 24*b*, the thickened ink is forcedly discharged from the recording heads 21 and is received by the flushing box 38.

When performance of a variety of maintenance operations as described above do not resolve the clogging of the nozzle openings 22, the nozzle openings 22 may be inspected using the microscope 52 in order to visually inspect the nozzle-forming surface 21*a* so as to determine the cause of the clog or printing error.

In this case, the carriage 16 is moved to the position above the maintenance unit 24*b*, as shown in FIG. 5A. Then, the driving motor 29 is driven reversely to rotate the lead screws 30 in the direction of reverse rotation. This causes the moving members 33 to move frontward, making the flushing box 38, under the urging force of the coil spring 50, move frontward along with the moving members 33 while gradually changing its orientation from horizontal to oblique as shown in FIG. 5B. When the moving members 33 are further moved frontward, the flushing box 38 finally is oriented perpendicularly as shown in FIG. 5C, and is held at the non-receiving position by the urging force of the coil spring 50.

In this state, the microscope 52 can take an image of the nozzle-forming surface 21*a*. The microscope 52 takes an image of the nozzle-forming surface 21*a*, while changing the field of view using the X-Y table 53. The cause of the clogging of the nozzle openings 22 can be inspected by visually inspecting the nozzle-forming surface 21*a* through the image reproduced on a monitor.

As a result of the visual inspection, if, for example, the presence of a foreign substance, congealed ink, or the like attached to the nozzle-forming surface 21*a* is confirmed, maintenance such as cleaning of the nozzle-forming surface 21*a* is performed while the image of the nozzle-forming surface 21*a* is shown on the monitor. A linear deposit of ink on the nozzle-forming surface 21*a* indicates that the wiper member 26 is cracked. In that case, the wiper member 26 is replaced.

According to the above-described embodiment, the following advantages can be achieved.

1. In the above-described embodiment, the cause of clogging of nozzle openings 22 can be easily inspected without needing to remove the recording heads 21 from the printer 11 by visually inspecting the nozzle-forming surface 21*a* with the microscope 52. Thus, the time required for removing and reattaching the recording heads 21 can be saved.

2. In the above-described embodiment, when the flushing box 38 is positioned at the receiving position, the flushing box 38 covers the nozzle-forming-surface visual-inspection unit 51. That is, the flushing box 38 and the nozzle-forming-surface visual-inspection unit 51 overlap each other in the perpendicular direction. Accordingly, the provision of the nozzle-forming-surface visual-inspection unit 51 does not increase the size of the liquid ejecting apparatus.

3. In the above-described embodiment, because the flushing box 38 covers the nozzle-forming-surface visual-inspection unit 51 during printing, ink mist is prevented from depositing on the nozzle-forming-surface visual-inspection unit 51 during printing or flushing.

4. In the above-described embodiment, the flushing box 38 is oriented perpendicularly at the non-receiving position. This creates a space between the recording heads 21 and the flushing box 38, which allows a member, such as a cotton bud, to be inserted for cleaning the recording heads 21.

5. In the above-described embodiment, the X-Y table 53 is capable of changing the field of view during visual inspection of the nozzle-forming surface 21*a*. Therefore, a desired area of the nozzle-forming surface 21*a* can be visually inspected.

6. In the above-described embodiment, because the microscope 52 enables visual inspection of the nozzle-forming surface 21*a* with a magnified image thereof, the fine nozzle openings 22 and the presence of a deposited substance can be visually inspected. The microscope 52 outputs an image it took in the form of an image signal. Thus, by providing the monitor for reproducing the image signal as an image on the external surface of the body case 12, visual inspection of the nozzle-forming surface 21*a* can be easily performed from the outside, and there is no need to open the body case 12 to perform an inspection. Further, by making the monitor show the image of the nozzle-forming surface 21*a* taken by the microscope 52, maintenance such as cleaning can be performed while visually inspecting the condition of the nozzle-forming surface 21*a*.

7. The positioning of a recording head requires precision, and can be quite time-consuming work. In the above-described embodiment, because a plurality of recording heads 21 are provided, the time required for removing and reattaching the recording head can be saved effectively.

The above-described embodiment may be modified into other embodiments as follows.

In the above-described embodiment, the mechanism for moving the flushing box 38 is not limited to the mechanism using the lead screws 30, and may be a mechanism using a rack and pinion or a lever, for example.

In the above-described embodiment, the flushing box 38 need not be oriented perpendicular to the nozzle-forming surface 21*a* when it is positioned at the non-receiving position. It may be oriented, for example, obliquely below the nozzle-forming surface 21*a*. Further, the flushing box 38 may be oriented horizontally at a position below the nozzle-forming surface 21*a* and away from the recording heads 21 in a lateral direction in which the nozzle-forming surface 21*a* extends when it is positioned at the non-receiving position, as long as a space is maintained between the flushing box 38 and the recording heads 21.

In the above-described embodiment, the nozzle-forming-surface visual-inspection unit 51 may have a mirror or a camera, instead of the microscope 52. When the nozzle-forming surface 21*a* is reflected in a mirror, for example, the body case 12 may be provided with a cover on the front surface thereof, which may be opened to allow visual inspection of the nozzle-forming surface 21*a* reflected in the mirror. When a camera takes an image of the nozzle-forming surface 21*a*, the image may be printed by the printer 11. When the nozzle-forming surface 21*a* is visually inspected using a mirror or a camera, a monitor for reproducing the image is not required.

In the above-described embodiment, the image taken by the microscope 52 may be reproduced on a monitor of a computer or the like, connected to the printer 11.

In the above-described embodiment, a picture recorder for recording the image taken by the microscope 52 may be used.

In the above-described embodiment, the nozzle-forming-surface visual-inspection unit 51 or the printer 11 may have a lighting unit for illuminating the nozzle-forming surface 21*a*.

In the above-described embodiment, the number of the recording heads 21 is not limited to three, and it may be one or another number other than three. When two or more recording heads 21 are provided, they are not necessarily arranged in a staggered formation as shown in the above-described embodiment, and they may be arranged in any formation.

In the above-described embodiment, the driving mechanism for changing the field of view of the microscope 52 is not limited to the X-Y table 53 for moving the microscope 52. A rack and pinion or a piston, for example, may be used to move the microscope 52. Alternatively, the field of view of the microscope 52 may be changed by rotating the microscope 52, by changing the magnification of the microscope 52, or by providing a plurality of microscopes having different magnifications, whose positions are changeable.

In the above-described embodiment, the X-Y table 53 may not be included. When the X-Y table 53 is not included, the microscope 52 may take an image of the entire nozzle-forming surface 21*a*. Alternatively, the microscope 52 may be provided in a plurality to increase the area being inspected. When the microscope 52 is provided in a plurality, they may be moved either simultaneously or individually.

In the above-described embodiment, the liquid ejecting apparatus may be embodied as a so-called line head printer, whose recording head has a size equivalent to the length of the recording paper P in the width direction (left-right direction). Because a printer of this type does not require the carriage to move in the main scanning direction, it may be configured such that the microscope 52 is moved by the driving mechanism in the top-bottom direction, the left-right direction, and the front-rear direction.

Although the liquid ejecting apparatus is embodied as an ink jet recording apparatus in the above-described embodiment, it may be embodied as a liquid ejecting apparatus capable of ejecting or discharging a liquid other than ink, including a liquid, a liquid containing particles of a functional material dispersed or mixed therein, a flowable material such as gel, and a solid material that can be flowed or ejected as liquid. The liquid ejecting apparatus may also be embodied as: a liquid ejecting apparatus capable of ejecting a liquid containing a material, such as an electrode material or a color material (pixel material), dispersed therein or dissolved therein; a liquid ejecting apparatus capable of manufacturing liquid crystal displays, electroluminescence (EL) displays, or surface emitting displays; a liquid ejecting apparatus capable of ejecting a living organic material, used for manufacturing biochips; a liquid ejecting apparatus capable of being used as a precision pipette, for ejecting a liquid serving as a sample; a liquid ejecting apparatus capable of ejecting lubricant onto a precision instrument, such as a clock or a camera, with a pinpoint accuracy; a liquid ejecting apparatus capable of ejecting a transparent liquid resin, such as an ultraviolet curable resin, onto a substrate, for fabricating hemispherical microlenses (optical lenses) usable in optical communication elements; a liquid ejecting apparatus capable of ejecting an acid or alkaline etchant to perform etching on a substrate; a flowable-material ejecting apparatus capable of ejecting a flowable material such as gel (for example, physical gel); and a powder or granular material ejecting apparatus (for example, a toner jet recording apparatus) capable of ejecting a solid, such as powder and granular material, e.g., toner. The invention can be applied to any of the above-described liquid ejecting apparatuses. As used herein, the term "liquid" refers to a substance excluding a liquid consisting exclusively of gas, and refers to a substance including, for example, liquid (including inorganic solvent, organic solvent, solution, liquid resin, and liquid metal (molten metal)), flowable material, powder, and granular material.

What is claimed is:

1. A liquid ejecting apparatus comprising:

a liquid ejecting head capable of ejecting liquid from nozzle openings provided in a nozzle-forming surface of the liquid ejecting head;

a nozzle-forming-surface visual-inspection unit for enabling a visual inspection of the nozzle-forming surface; and a liquid receptacle capable of receiving liquid discharged as waste liquid from the nozzle openings in the liquid ejecting head, wherein the liquid receptacle is capable of being moved between a receiving position, where the liquid receptacle is positioned adjacent to and facing the nozzle-forming surface so as to cover the nozzle-forming-surface visual inspection unit, and a non-receiving position, where the liquid receptacle is positioned away from the receiving position so as to allow the nozzle-forming-surface visual-inspection unit to enable visually inspection of the nozzle-forming surface, wherein the liquid receptacle is positioned below the nozzle-forming surface and is oriented perpendicularly or obliquely to the nozzle-forming surface in a direction that is lateral to the nozzle-forming surface when the liquid receptacle is positioned at the non-receiving position.

2. The liquid ejecting apparatus according to claim 1, wherein the nozzle-forming-surface visual-inspection unit includes a driving mechanism for changing a field of view during the visual inspection of the nozzle-forming surface.

3. The liquid ejecting apparatus according to claim 1, wherein the nozzle-forming-surface visual-inspection unit includes a microscope for taking an image of the nozzle-forming surface and outputting the image in the form of an image signal, and a monitor for reproducing the image signal as an image.

4. The liquid ejecting apparatus according to claim 1, wherein a plurality of liquid ejecting heads are provided in the liquid ejecting apparatus.

5. A liquid ejecting apparatus comprising:

a liquid ejecting head capable of ejecting liquid from nozzle openings provided in a nozzle-forming surface of the liquid ejecting head;

a nozzle-forming-surface visual-inspection unit for enabling a visual inspection of the nozzle-forming surface; and a liquid receptacle capable of receiving liquid discharged as waste liquid from the nozzle openings in the liquid ejecting head and being moved between a receiving position where the liquid receptacle is positioned below the nozzle-forming surface and a non-receiving position where the liquid receptacle is positioned below and perpendicular to the nozzle-forming surface;

wherein the nozzle-forming-surface visual-inspection unit is capable of enabling the visual inspection of the nozzle-forming surface when the liquid receptacle is in the non-receiving position.

6. The liquid ejecting apparatus according to claim 5, wherein the liquid receptacle is positioned below the nozzle-forming surface and is oriented perpendicularly or obliquely to the nozzle-forming surface when the liquid receptacle is positioned at the non-receiving position.

7. The liquid ejecting apparatus according to claim 5, wherein the nozzle-forming-surface visual-inspection unit includes a driving mechanism for changing a field of view during the visual inspection of the nozzle-forming surface.

8. The liquid ejecting apparatus according to claim 5, wherein the nozzle-forming-surface visual-inspection unit includes a microscope for taking an image of the nozzle-forming surface and outputting the image in the form of an image signal, and a monitor for reproducing the image signal as an image.

9. The liquid ejecting apparatus according to claim 5, wherein a plurality of liquid ejecting heads are provided in the liquid ejecting apparatus.

* * * * *